252-99 AU 166 EX
10/14/80 OR 4,228,025

United States Patent [19]

Jacobsen

[11] 4,228,025

[45] Oct. 14, 1980

[54] AGGLOMERATION PROCESS FOR MAKING GRANULAR DETERGENTS

[75] Inventor: Ronald L. Jacobsen, Wyoming, Ohio

[73] Assignee: The Procter & Gamble Company, Cincinnati, Ohio

[21] Appl. No.: 53,574

[22] Filed: Jun. 29, 1979

[51] Int. Cl.[2] ..... C11D 3/075; C11D 3/08; C11D 3/395; C11D 11/00

[52] U.S. Cl. ..... 252/99; 23/313 R; 23/313 AS; 252/135; 252/174; 252/174.13; 252/174.14; 252/174.21

[58] Field of Search ..... 23/313 R, 313 AS; 252/97, 99, 135, 174, 174.13, 174.14, 174.21

[56] References Cited

U.S. PATENT DOCUMENTS

| | | | |
|---|---|---|---|
| 2,689,225 | 9/1954 | Anderson | 252/99 |
| 2,895,916 | 7/1959 | Milenkevich | 252/99 |
| 3,247,118 | 4/1966 | Matthaei | 252/99 |
| 3,248,330 | 4/1966 | Feierstein | 252/99 |
| 3,520,815 | 7/1970 | Wessells | 252/99 |
| 3,598,743 | 8/1971 | Coates | 252/99 |
| 3,600,317 | 8/1971 | Lintner | 252/99 |
| 3,620,979 | 11/1971 | Corliss | 252/385 |
| 3,625,902 | 12/1971 | Sumner | 252/99 |
| 3,630,928 | 12/1971 | Fuchs | 252/135 |
| 3,741,904 | 6/1973 | Christensen | 252/99 |
| 3,812,045 | 5/1974 | Gray | 252/99 |
| 3,888,781 | 6/1975 | Kingry | 252/99 |
| 4,169,806 | 10/1979 | Davis | 252/99 |

*Primary Examiner*—Dennis L. Albrecht
*Attorney, Agent, or Firm*—Edmund F. Gebhardt; Thomas H. O'Flaherty; Richard C. Witte

[57] ABSTRACT

Granular detergent compositions comprising at least 15% sodium tripolyphosphate are prepared by agglomeration with an agglomerating agent comprising an alkali metal silicate solution such process comprising addition of such agglomerating agent to a first portion of sodium tripolyphosphate and the addition of a second portion of sodium tripolyphosphate to the mixture of said first portion and the agglomerating agent after at least about 30% of the agglomerating agent has been added.

7 Claims, No Drawings

AGGLOMERATION PROCESS FOR MAKING GRANULAR DETERGENTS

BACKGROUND OF THE INVENTION

This invention relates to a process for making a granular detergent product and the product of the process. More particularly, the invention relates to a process for preparing detergent compositions which are useful in automatic dishwashing machines.

Detergent compositions comprising in combination an alkali metal polyphosphate such as sodium tripolyphosphate, alkaline salts such as sodium silicate a surfactant and optionally a chlorine containing compound that provides hypochlorite ion in solution have particular utility for machine dishwashing. The production of such compositions made of agglomerates of the ingredients has been generally accomplished by the addition of an aqueous sodium silicate solution to a mixture of dry ingredients. However, compositions prepared in such manner are characterized by a tendency to cake in their cartons during storage and can also have a tendency to cake in the dispenser cups of automatic dishwashing machines. A number of process modifications have been suggested to reduce the caking tendency of detergent compositions prepared using silicate solutions as agglomerating agents. U.S. Pat. No. 2,895,916 discloses an order of addition in which a chlorine containing compound, chlorinated trisodium phosphate, is added to the composition only after the aqueous silicate has been added to an anhydrous polyphosphate. The benefit is said to result from a more rapid hydration of the sodium tripolyphosphate in the absence of chlorinated trisodium phosphate. Copending commonly assigned U.S. Ser. No. 932,107 of J. E. Davis et al discloses that a reduction in the carton caking tendency of agglomerated detergent compositions containing alkali metal polyphosphates and alkali metal silicates can be achieved if from about 2% to about 20% of a hydratable salt other than the alkali metal silicate is incorporated in the aqueous silicate solution used to agglomerate the alkali metal polyphosphate.

It has now been found that a substantial reduction in the carton caking tendency of agglomerated detergent compositions containing sodium tripolyphosphate and an alkali metal silicate can be achieved if from about 5% to about 50% of the total sodium tripolyphosphate in the composition is withheld from the agglomeration process until at least about 30% of the alkali metal silicate solution has been added.

It is an object of this invention to produce agglomerated granular detergent compositions containing sodium tripolyphosphate and alkali metal silicate which are resistant to caking.

It is another object of this invention to utilize powdered sodium tripolyphosphate with a particle size such that about 90% passes through a 100 mesh Tyler Standard screen as a substitute for a portion of granular sodium tripolyphosphate with a particle size such that less than about 10% passes through a 100 mesh Tyler Standard screen in an agglomeration process utilizing sodium tripolyphosphate and alkali metal silicate solutions.

Other objects and advantages will be apparent from the following description and examples.

SUMMARY OF THE INVENTION

This invention comprises a process for preparing an agglomerated granular detergent composition comprising from about 50% to about 99.5% by weight of inorganic materials selected from the group consisting of alkali metal polyphosphates, orthophosphates, silicates, carbonates, sulfates and mixtures thereof and at least about 15% sodium tripolyphsophate and from 0% to about 20% of a surfactant in which the agglomerating agent is an alkali metal silicate solution having a water content of from about 40% to about 75%, an average $SiO_2:M_2O$ weight ratio of from about 1.6 to about 3.3, M being an alkali metal. The present invention also comprises the granular detergent compositions characterized by resistance to caking which are made by the process.

The invention provides a process for preparing an agglomerated granular detergent composition comprising at least about 15% sodium tripolyphosphate by weight, from about 50% to about 99.5% by weight of inorganic materials inclusive of the sodium tripolyphosphate selected from the group consisting of alkali metal polyphosphates, orthophosphates, chlorinated orthophosphates, silicates, carbonates, sulfates and mixtures thereof and from 0% to about 20% of a surfactant, in which the agglomerating agent comprises an alkali metal silicate solution having a water content of from about 50% to about 75%, an average $SiO_2:M_2O$ weight ratio of from about 1.6 to about 3.3, M being an alkali metal, said process comprising:

(a) the addition of the agglomerating agent to a first portion of the sodium tripolyphosphate consisting of from about 50% to about 95% of the total sodium tripolyphosphate in the detergent composition, said first portion having a particle size distribution such that at least 30% by weight is retained on a 100 Tyler mesh screen, and (b) the addition of a second portion of sodium tripolyphosphate to a mixture of the first portion of sodium tripolyphosphate and the agglomerating agent after at least about 30% of the agglomerating agent has been added to the first portion of sodium tripolyphosphate.

In a preferred embodiment the second portion of sodium tripolyphosphate has a particle size distribution such that at least 70% by weight passes through a 100 Tyler mesh screen.

In another preferred embodiment the second portion of sodium tripolyphosphate is added after at least about 50% of the agglomerating agent has been added but before about 95% of the agglomerating agent has been added.

Preferred detergent compositions of the present invention contain a compound providing hypochlorite ions in aqueous solution.

DETAILED DESCRIPTION OF THE INVENTION

The process of the invention is carried out in apparatus suitable for the mixing of dry particulate components and adapted so that liquid components such as the alkali metal silicate agglomerating agent can be sprayed on or otherwise added to a bed or falling curtain of one or more particulate components during the mixing operation. Any suitable mixing device such as an inclined pan agglomerator, a rotating drum, a ribbon maker or any other vessel with suitable means of agitation may be used. Methods of agitating, mixing and agglomerating particulate components are well-known to those skilled in the art. The apparatus may be designed or adapted for either continuous or batch operation so long as the essential process steps can be achieved.

Optional process steps include screening of particulate materials before processing, screening or grinding the final composition to any desired particle size, and allowing the final composition to come to equilibrium with respect to temperature and hydration before packing into cartons.

A theoretical basis for the unexpected improvement in caking resistance provided by the process of the invention is not clearly apparent. It is believed to be at least partially related to the complex hydration characteristics of sodium tripolyphosphate. This compound has different hydration characteristics depending on its particle size and its method of manufacture. A so-called Form I is produced if the process of manufacture includes a relatively high temperature calcination step. A Form II results when lower temperatures are employed. Form I is characterized by relatively rapid hydration characteristics. Form II, particularly in the absence of any substantial level of Form I material, is slow to hydrate, but has a greater immediate solubility. Commercially available sodium tripolyphosphates are generally a mixture of Form I and Form II. U.S. Pat. Nos. 2,622,068; 2,961,409 and 2,961,410, incorporated herein by reference disclose the hydration characteristics of Form I and Form II sodium tripolyphosphate in the manufacture of spray-dried detergents.

In the agglomeration process of the present invention a relatively rapid, but controlled hydration is desirable. It is clearly desirable to achieve hydration equilibrium before packing product in cartons. Too rapid a hydration, however, can result in a temperature rise which complicates agglomeration and can result in product deterioration, e.g., breakdown of optional ingredients that provide hypochlorite ion in solution.

The process and product of this invention apply to granular detergent compositions comprising as essential ingredients, sodium tripolyphosphate and alkali metal silicates.

THE ALKALI METAL POLYPHOSPHATE

The detergent compositions made by the process of the invention contain sodium tripolyphosphate at a total level of at least about 15% and preferably from about 20% to about 50% by weight. Other polyphosphates useful in the practice of the invention are the water-soluble sodium and potassium salts of pyrophosphoric acid ($H_4P_2O_7$), the potassium salt of tripolyphosphoric acid $H_5P_3O_{10}$, and the sodium and potassium salts of polymeric metaphosphoric acid $(HPO_3)n$. The value of n is typically below about 50 in the interest of water solubility. The sodium and potassium salts of metaphosphoric acid are often designated "glassy" phosphates and exist as a series of polymers. Glassy phosphates may also be represented by the formula $(M_2O)m(P_2O_5)n$ wherein M is an alkali metal, n is in the range of from about 5 to about 50 and m:n is in the range of 1:1 to 1:1.5 on a molar basis. An example of a glassy phosphate is sodium hexametaphosphate ($Na_6P_6O_{18}$). Sodium tripolyphosphate ($Na_5P_3O_{10}$) is a required material in the practice of the invention and can be the sole alkali metal polyphosphate.

Commercial sodium tripolyphosphate generally has a Phase I content of from about 20% to about 33%. Granular sodium tripolyphosphate has a particle size distribution such that only about 5% to about 10% will pass through a 100 mesh Tyler screen. From 0% to about 20% can be expected to be retained on a 20 mesh Tyler screen. Powdered sodium tripolyphosphate has a particle size distribution such that at least about 90% can be expected to pass through a 100 mesh Tyler screen and at least about 70% can be expected to pass through a 270 mesh Tyler screen.

In general, granular sodium tripolyphosphate has been utilized in granular detergent products made by agglomeration with alkali metal silicate solutions. High levels of powdered material tends to complicate processing and can result in unacceptable caking in the dispenser cups of automatic dishwashing machines. Mixtures of granular and powdered sodium tripolyphosphate are useful in the practice of the invention. Mixtures with relatively high ratios of granular to powdered material are preferred in the first portion of sodium tripolyphosphate with which the agglomeration process is initiated. At least about 30% and preferably at least about 60% of the first portion is retained on a 100 mesh Tyler screen. Mixtures of relatively high ratio of powdered to granular material or 100% powdered material is preferred for the second portion of sodium tripolyphosphate.

THE ALKALI METAL SILICATE

The compositions made by the process of this invention contain alkali metal silicates generally at a level of from about 5% to about 25% on an anhydrous weight basis. Particularly preferred is a sodium silicate having a weight ratio of $SiO_2$:$Na_2O$ of from about 1.6 to about 3.3, most preferably from about 2 to about 3.2. Lower ratio silicates which are relatively more alkaline provide good cleaning performance but in order to provide protection to materials such as aluminum and china, it is desirable to have at least 10% and up to 75% of the $SiO_2$ present at a $SiO_2$:$Na_2O$ ratio above 3.0. It is possible to add all of the silicate in the form of aqueous solution typically containing from about 35% to about 45% silicate solids but a portion may be part of the dry mix. The alkali metal silicate solutions used as agglomerating agents in the practice of the invention contain from about 50% to about 75% water, preferably from about 50% to about 65% water, and most preferably from about 55% to about 63% water.

THE OPTIONAL HYPOCHLORITE ION COMPOUND

The source of hypochlorite ion is a chlorine bleach component, a compound which contains chlorine in active form. The ability of a compound to provide hypochlorite ion in solution is generally measured as "available chlorine". The available chlorine reflects the method of producing an inorganic hypochlorite (e.g., $2\,NaOH + Cl_2 \rightarrow NaOCl + NaCl + H_2O$). Available chlorine is the chlorine liberated by acidification of a solution of hypochlorite ions and at least a molar equivalent amount of chloride ions. The usual analytical method of determining available chlorine in a solution is addition of an excess of an iodide salt and titration of the liberated free iodine with a reducing agent. The compositions provided by the process of this invention preferably have hypochlorite ion producing compounds in an amount sufficient to provide available chlorine equal to from about ½% to about 4% by weight of the composition. This corresponds to about 0.52% to 4.2% by weight of sodium hypochlorite.

The preferred source of available chlorine is chlorinated trisodium phosphate.

The term "chlorinated trisodium phosphate" designates a composition consisting of trisodium phosphate and sodium hypochlorite in intimate association in the crystalline form. A nominal formula is $(Na_3PO_4.11H_2O)_4.NaOCl$. Commercially available chlorinated trisodium phosphate typically contains from 1% to 5% available chlorine and can be prepared by the methods of U.S. Pat. No. 1,555,474 or U.S. Pat. No. 1,965,304 or modifications thereof, incorporated herein by reference.

Although the preferred source of available chlorine is chlorinated trisodium phosphate, other materials which can be used are sodium and potassium dichlorocyanurates, dichlorocyanuric acid; 1,3-dichloro-5,5-dimethyl hydantoin; N,N'-dichlorobenzoylene urea; paratoluene sulfondichloroamide; trichloromelamine; N-chloroammeline; N-chlorosuccinimide; N,N'-dichloroazodicarbonamide; N-chloroacetyl urea; N,N'-dichlorobiuret; chlorinated dicyandiamide; sodium hypochlorite; calcium hypochlorite; and lithium hypochlorite. Of the materials other than chlorinated trisodium phosphate, alkali metal dichlorocyanurates are preferred for effectiveness, stability and availability.

THE OPTIONAL SURFACTANT

The compositions of this invention can contain from 0% to about 20% surfactant by weight. A preferred level of surfactant is from about 2% to about 10%. Preferably the surfactant is an alkoxylated nonionic surfactant and preferably the composition is essentially free of sulfonated or sulfated anionic surfactants.

Examples of nonionic surfactants include:

(1) the condensation product of 1 mole of a saturated or unsaturated, straight or branched chain, alcohol or fatty acid containing from about 10 to about 20 carbon atoms with from about 4 to about 50 moles of ethylene oxide. Specific examples of such compounds include a condensation product of 1 mole of coconut fatty acid or tallow fatty acid with 10 moles of ethylene oxide; the condensation of 1 mole of oleic acid with 9 moles of ethylene oxide; the condensation product of 1 mole of stearic acid with 25 moles of ethylene oxide; the condensation product of 1 mole of tallow fatty alcohols with about 9 moles of ethylene oxide; the condensation product of 1 mole of oleyl alcohol with 10 moles of ethylene oxide; the condensation product of 1 mole of $C_{19}$ alcohol and 8 moles of ethylene oxide; and the condensation product of one mole of $C_{18}$ alcohol and 9 moles of ethylene oxide.

The condensation product of a fatty alcohol containing from 17 to 19 carbon atoms, and being substantially free of chain lengths above and below these numbers, with from about 6 to about 15 moles, preferably 7 to 12 moles, most preferably 9 moles, of ethylene oxide is particularly preferred, especially when capped with a low molecular weight ($C_{1-5}$) acid or alcohol moiety, so as to minimize or eliminate the need for a suds-suppressing agent. Suds-suppressing agents tend to reduce cleaning performance.

(2) Polyethylene glycols having molecular weights of from about 1,400 to about 30,000, e.g., 20,000 9,500; 7,500; 6,000; 4,500; 3,400; and 1,450. All of these materials are waxlike solids which melt between 110° F. and 200° F.

(3) The condensation products of 1 mole of alkyl phenol wherein the alkyl chain contains from about 8 to about 18 carbon atoms and from about 4 to about 50 moles of ethylene oxide. Specific examples of these nonionics are the condensation products of 1 mole of decylphenol with 40 moles of ethylene oxide; the condensation product of 1 mole of dodecyl phenol with 35 moles of ethylene oxide; the condensation product of 1 mole of tetradecylphenol with 25 moles of ethylene oxide; the condensation product of 1 mole of hectadecylphenol with 30 moles of ethylene oxide, etc.

(4) Polyoxypropylene, polyoxyethylene condensates having the formula $HO(C_2H_4O)x(C_3H_6O)y\ (C_2H_4O)x\ H$ where y equals at least 15 and $(C_2H_4O)x+x$ equals 20% to 90% of the total weight of the compound and the molecular weight is from about 2,000 to about 10,000, preferably from about 3,000 to about 6,000. These materials are, for example, the Pluronics which are well known in the art.

(5) The compounds of (1) which are capped with propylene oxide, butylene oxide and/or short chain alcohols and/or short chain fatty acids, e.g., those containing from 1 to about 5 carbon atoms, and mixtures thereof.

Preferred surfactants are those having the formula $RO—(C_2H_4O)_xR^1$ wherein R is an alkyl or alkylene group containing from 17 to 19 carbon atoms, x is a number from about 6 to about 15, preferably from about 7 to about 12, and $R^1$ is selected from the group consisting of: preferably, hydrogen, $C_{1-5}$ alkyl groups, $C_{2-5}$ acyl groups and groups having the formula $—(C_yH_{2y}O)_nH$ wherein y is 3 to 4 and n is a number from 1 to about 4.

Also preferred are the low sudsing compounds of (4), the other compounds of (5), and the $C_{17-19}$ materials of (1) which have a narrow ethoxy distribution.

In addition to the above mentioned surfactants, other suitable surfactants can be found in the disclosure of U.S. Pat. Nos. 3,544,473, 3,630,923, 3,888,781 and 4,001,132, all of which are incorporated herein by reference.

ALKALI METAL CARBONATES AND ORTHOPHOSPHATES

Optionally, the process and composition of the invention utilize alkali metal, particularly sodium carbonate and orthophosphate to provide the alkalinity reserve needed for optimum cleaning performance. The preferred source of available chlorine, chlorinated trisodium phosphate, thus has a dual function when used in the compositions of the invention at a preferred level of from about 15% to about 40% by weight. Nonchlorinated alkali metal orthophosphates can be used, particularly when an organic chlorine bleach such as potassium dichlorocyanurate is the source of hypochlorite ions.

Alkali metal carbonates, particularly sodium carbonate, can be present in the compositions at levels up to about 20% by weight.

OTHER OPTIONAL INGREDIENTS

In addition to the above ingredients it can be desirable to incorporate one of the many suds-suppressing ingredients disclosed in the above mentioned patents which have been incorporated by reference at a level of from about 0.001% to about 10%, preferably from about 0.05% to about 3%. Preferred suds suppressing materials are mono- and distearyl acid phosphates; the self-emulsified siloxane suds-suppressors of pending U.S. Patent application Ser. No. 841,078, filed Oct. 11, 1977, by T. W. Gault and Edward John McGuire, Jr. and mixtures thereof.

Organic sequestering builders such as citrates and nitrilotriacetates can be present in the compositions, but perferably at levels no greater than about 10% by weight. The presence of organic builders tends to hurt the performance of these compositions by leaving visible spots and filming on glassware. The polyphosphate builders are relatively free of these deficiencies.

China protecting agents including aluminosilicates, aluminates, etc., can be present in amounts up to about 5%, preferably from about 0.2% to about 2%.

Filler materials to control product physical characteristics can also be present including sodium acetate, sucrose, sucrose esters, sodium chloride, sodium sulfate, etc., in amounts up to about 60%, preferably not more than about 30%.

Hydrotrope materials such as sodium benzene sulfonate, sodium toluene sulfonate, sodium cumene sulfonate, etc., can be present in minor amounts, but, as with other organic materials, their presence is normally minimized.

Dyes, perfumes, crystal modifiers and the like can also be added in minor amounts.

As used herein, all percentages, parts and ratios are by weight unless otherwise stated.

The following Examples illustrate the invention and facilitate its understanding.

EXAMPLE I 45.3 parts by weight of granular anhydrous sodium tripolyphosphate was added to a ribbon mixer. With the mixer in operation the following ingredients were added during a cycle time of 183 seconds:

(a) from 8 seconds to 153 seconds—added as a spray 16.7 parts of aqueous silicate solution containing 43% sodium silicate with a $SiO_2$:$Na_2O$ ratio of 2.58 premixed with 16.7 parts of aqueous silicate solution containing 37.5% sodium silicate with a $SiO_2$:$Na_2O$ ratio of 3.2. This solution also contained minor amounts of perfume and dye solution.

(b) from 45 seconds to 147 seconds—added as a spray 2.7 parts of a polyoxyalkylene nonionic surfactant (Pluradot HA-433, BASF Wyandotte Corp., a polyethylene oxide—polypropylene oxide copolymer containing a monostearyl acid phosphate suds suppressor)

(c) from 108 seconds to 115 seconds—added dry 22.1 parts of chlorinated sodium phosphate with 3.5% available chlorine and including 10.5 parts (47%) of water of crystallization.

(d) from 153 seconds to 183 seconds

Product is discharged from mixer.

A second detergent composition was prepared in accordance with the above procedure except that 15% by weight of the total granular anhydrous sodium tripolyphosphate with more than 90% retained on a 100 mesh Tyler screen is replaced by powdered sodium tripolyphosphate with less than 10% on a 100 mesh Tyler screen.

A third detergent composition was prepared in accordance with the above procedure except that 15% by weight of total granular anhydrous sodium tripolyphosphate added initially to the mixer is removed and replaced by powdered sodium tripolyphosphate added from 100 seconds to 108 seconds.

The compositions were packed in 50 oz. cardboard cartons with a polyethylene film laminate and an aluminum foil overwrap. The resistance to carton caking was measured after storage time and conditions as indicated in the table below. A mechanized pouring testing device was used to evaluate the samples. The device rotates opened cartons through a 100° arc, stops briefly and then returns the carton to an upright position. This procedure is repeated to determine a "free pour" grade. Following the free pour test cycle, cartons with any remaining product are subjected to four "shake-pour" cycles which repeat the 100° arc of the carton with a gentle continuous lateral shaking action. This procedure provides a "total pour" grade. Values below are the average of 4 replicate cartons.

| | Percent Product Removed-Total Pour | | | |
|---|---|---|---|---|
| Storage Conditions | 90° F. | | South Florida Cycle* | |
| Storage Time | 2 wks. | 4 wks. | 2 wks. | 4 wks. |
| Product | | | | |
| (1) Control-100% granular at start | 91 | 71 | 89 | 79 |
| (2) 15% powder at start | 90 | 87 | 66 | 70 |
| (3) 15% powder at 100 sec. (after 65% of agglomerating agent added) | 100 | 92 | 93 | 95 |

*The South Florida cycle is a storage condition simulating climatic conditions in South Florida. Typically, the temperature cycles between 80° F. and 92° F. and the humidity varies independently between 50% Relative Humidity and 87% Relative Humidity over a period of 24 hours.

The process of Example I was conducted with the variations as noted. "Control" indicates 100% granular sodium tripolyphosphate added at the start of the agglomeration cycle and no later addition.

| | Percent Product Removed-Total Pour | | | | | |
|---|---|---|---|---|---|---|
| Storage Conditions | 90° F. | | 100° F. | | South Florida Cycle | |
| Storage Time | 2 wks. | 4 wks. | 2 wks. | 4 wks. | 2 wks. | 4 wks. |
| EXAMPLE II | | | | | | |
| (1) Control | 2 | 17 | | | 15 | 7 |
| (2) 15% powder - after 65% | 52 | 34 | | | 75 | 38 |
| (3) 15 powder - after 95% | 46 | 50 | | | 97 | 52 |
| EXAMPLE III | | | | | | |
| (1) Control | 100 | 85 | 87 | 73 | 100 | 96 |
| (2) 15% powder - after 65% | 100 | 99 | 100 | 94 | 100 | 100 |
| EXAMPLE IV | | | | | | |
| (1) Control | 66 | 33 | 19 | 17 | 75 | 43 |
| (2) 15% powder - after 65% | 96 | 63 | 61 | 37 | 98 | 63 |
| EXAMPLE V-Pour Without Shake (Free Pour) | | | | | | |
| (1) Control | 51 | 64 | | | | |
| (2) 15% powder - after 65% | 99 | 97 | | | | |
| (3) 15% granular - after 65% | 91 | 79 | | | | |
| EXAMPLE VI-Pour Without Shake (Free Pour) | | | | | | |
| (1) Control | 61 | 27 | | | | |
| (2) 30% granular - after 65% | 88 | 87 | | | | |
| EXAMPLE VII | | | | | | |
| (1) Control | 97 | 72 | | | | |
| (2) 30% | | | | | | |

-continued

| Storage Conditions | Percent Product Removed-Total Pour | | | | | |
|---|---|---|---|---|---|---|
| | 90° F. | | 100° F. | | South Florida Cycle | |
| Storage Time | 2 wks. | 4 wks. | 2 wks. | 4 wks. | 2 wks. | 4 wks. |
| granular - after 65% | 100 | 100 | | | | |
| | | EXAMPLE VIII | | | | |
| (1) Control | 62 | 48 | 30 | 16 | 92 | 74 |
| (2) 15% powder - after 70% | 100 | 97 | 94 | 96 | 100 | 100 |
| (3) 15% powder - after 52% | 100 | 100 | 100 | 71 | 100 | 100 |
| | | EXAMPLE IX* | | | | |
| (1) Control | 93 | | | | 98 | 68 |
| (2) 15% powder - after 65% | 100 | | | | 100 | 100 |

*$C_{18}$ straight chain alcohol ethoxylated with 9 moles of ethylene oxide substituted for Pluradot HA 433.

What is claimed is:

1. A process for preparing an agglomerated granular detergent composition comprising at least about 15% sodium tripolyphosphate by weight, from about 50% to about 99.5% by weight of inorganic materials selected from the group consisting of alkali metal polyphosphates, orthophosphates, chlorinated orthophosphates, silicates, carbonates, sulfates and mixtures thereof and from 0% to about 20% of a surfactant, in which the agglomerating agent comprises an alkali metal silicate solution having a water content of from about 50% to about 75%, an average $SiO_2$:$M_2O$ weight ratio of from about 1.6 to about 3.3, M being an alkali metal, said process comprising:

(a) the addition of the agglomerating agent to a first portion of the sodium tripolyphosphate consisting of from about 50% to about 95% of the total sodium tripolyphosphate in the detergent composition, said first portion having a particle size distribution such that at least 30% by weight is retained on a 100 Tyler mesh screen, and (b) the addition of a second portion of sodium tripolyphosphate to a mixture of the first portion of sodium tripolyphosphate and the agglomerating agent after at least about 30% of the agglomerating agent has been added to the first portion of sodium tripolyphosphate.

2. The process of claim 1 wherein the second portion of sodium tripolyphosphate has a particle size distribution such that at least 70% by weight passes through a 100 Tyler mesh screen.

3. The process of claims 1 or 2 wherein the second portion of sodium tripolyphosphate is added after at least about 50% but not more than about 95% of the agglomerating agent has been added to the first portion of sodium tripolyphosphate.

4. The process of claim 1 wherein the agglomerated granular detergent composition comprises a material providing hypochlorite ions in aqueous solution.

5. The process of claim 1 wherein the agglomerated granular detergent composition comprises from about 0.5% to about 20% of an alkoxylated nonionic surfactant.

6. The process of claim 5 wherein the alkoxylated nonionic surfactant comprises from about 2% to about 10% by weight of the agglomerated granular detergent composition.

7. The process of claims 1 or 4 wherein the material providing hypochlorite ions is chlorinated sodium orthophosphate.

* * * * *